US007341986B1

(12) United States Patent
Kalusha

(10) Patent No.: US 7,341,986 B1
(45) Date of Patent: Mar. 11, 2008

(54) CLEANING CONCENTRATE CONSISTING OF EXTRA VIRGIN OLIVE OIL AND ISOPROPYL ALCOHOL

(76) Inventor: Murtie Nina Kalusha, 1798 Rolling Hills Dr., Prescott, AZ (US) 86303

( * ) Notice: Subject to any disclaimer, the term of this patent is extended or adjusted under 35 U.S.C. 154(b) by 206 days.

(21) Appl. No.: 11/397,388

(22) Filed: Apr. 5, 2006

Related U.S. Application Data

(60) Provisional application No. 60/764,631, filed on Feb. 3, 2006.

(51) Int. Cl.
*C11D 3/382* (2006.01)
*C11D 3/43* (2006.01)

(52) U.S. Cl. ..... 510/417; 510/119; 510/130; 510/157; 510/181; 510/182; 510/238; 510/251; 510/271; 510/371; 510/405; 510/406; 510/407; 510/432; 510/437; 510/525

(58) Field of Classification Search ..... 510/119, 510/130, 157, 181, 182, 238, 251, 271, 371, 510/405, 406, 407, 417, 432, 437, 525
See application file for complete search history.

(56) References Cited

U.S. PATENT DOCUMENTS 5,026,553 A * 6/1991 Swinney ..... 424/757
5,223,257 A * 6/1993 Arora ..... 424/742
6,099,864 A * 8/2000 Morrison et al. ..... 424/489
6,103,271 A * 8/2000 Morrison et al. ..... 424/490
6,146,639 A * 11/2000 Merich ..... 424/769
6,451,605 B1 * 9/2002 Levin et al. ..... 424/725
6,635,274 B1 * 10/2003 Masiz et al. ..... 424/449
2005/0196367 A1 * 9/2005 Ohta et al. ..... 424/70.1
2006/0159763 A1 * 7/2006 Meyer et al. ..... 424/473
2006/0275238 A1 * 12/2006 Blasko-Begoihn et al. ..... 424/70.13

* cited by examiner

*Primary Examiner*—Charles Boyer

(57) ABSTRACT

The invention, a stable composition of matter, has a 2 step method to make (maintain the same equalities in increased batches). Step #1. 0.4167 Extra Virgin Olive Oil First Cold Pressed, which is a high quality olive oil, 0.5833 IPA, Isopropyl Alcohol 70%, shake to emulsify and create concentrate. Step #2 Using a 32 ounce empty plastic spray mist bottle, put 0.0625=2 ounces of contract from step #1. In plastic spray mist bottle, add 0.4375=14 ounces of tap water to plastic bottle, replace spray mist cap and shake. Suitable to Cross clean, the human body, plants leaves, natural and man-made finished products, fine ash particle controller, controls ash from becoming air borne. In addition the composition of matter cleaning solution will use minimal amounts of water in the cleaning and particle control process.

3 Claims, No Drawings

CLEANING CONCENTRATE CONSISTING OF EXTRA VIRGIN OLIVE OIL AND ISOPROPYL ALCOHOL

CROSS-REFERENCE TO RELATED APPLICATIONS

I, Murtie Nina Kalusha claim benefits from application No. 60/764,631 Feb. 3, 2006 and application Ser. No. 11/397,388 Apr. 5, 2006.

STATEMENT REGARDING FEDERALLY SPONSORED RESEARCH OR DEVELOPMENT

"NOT APPLICABLE"

REFERENCE TO SEQUENCE LISTING, A TABLE, OR A COMPUTER PROGRAM LISTING COMPACT DISC APPENDIX

"NOT APPLICABLE"

BACKGROUND OF THE INVENTION

The invention, is a stable composition of matter, that relates to aqueous all purpose cleaner and ash particle controller, containing Extra Virgin Olive Oil-First Cold Pressed and IPA, Isopropyl Alcohol 70%, and Tap water. The Extra Virgin Olive Oil-First Cold Pressed is a high quality olive oil. Olive oil, has been used for centuries in beauty treatment, soaps and many other valuable health related treatment as well as being suitable for other elements. IPA, Isopropyl Alcohol 70%, is a rubbing alcohol that contains an antiseptic suitable for inclusion into many beauty product, soaps and other cleaning products. When the Extra Virgin Olive Oil—First Cold Pressed and the Alcohol 70%, is combined and emulsified it is suitable for dilution with tap water for a stable aqueous composition of matter multi-function cleaner and particle controller, which will use minimal amounts of water.

In the past and currently, multi-purpose cleaner's composition of matter, has not been suitable for major cross-cleaning. They are to harsh for multiple cleaning tasks, regarding the cross-cleaning or just refreshment of: Humans, Plant leaves, Natural and Man-Made Finished Products, as well as, controlling ash particle from become airborne. In addition to giving a quality standard of cleaning with minimal amounts of water usage.

BRIEF SUMMARY OF INVENTION

The invention, is a stable composition of matter, composed of Extra Virgin Olive Oil-First Cold Pressed, which is a high quality olive oil, IPA, Isopropyl Alcohol 70%, Tap Water, suitable for a stable multi-functional cleaner that delivers quality cross cleaning or refreshment to the external human body, skin, cuticles, scalp and hair, not to be used in eyes, in addition to quality cleaning or refreshing the human body's skin, cuticles, scalp and hair, the composition of matter is suitable for waxy plant leaves, natural and man-made finished products, such as, counters tops, finished wood products metals, porcelain, marble. My composition of matter will control cold ash particles from becoming air borne, while they are being removed from fireplace. Just spray the cold ash well and remove. My composition of matter solution, will cleaning soot from fire box opening, glass and skin.

The invention, will deliver a quality standard of cleaning while conserving water in the cleaning process, which is a major issue in many states of The United States of America, as well as other countries.

The Invention, a stable composition of matter, could be one solution to a complicated problem which challenges the world community regarding access to a quality standard of cleanliness due to the lack of abundant water supplies. My invention not only has ease of portability it can produce the same standard of cleanliness in both normal and abnormal situation. Abnormal being situation such as, disasters, homelessness, pandemic flue out-break or traveling.

BRIEF DESCRIPTION OF THE SEVERAL VIEWS OF THE DRAWING

"NOT APPLICABLE"

DETAILED DESCRIPTION OF THE INVENTION

The invention, a stable composition of matter, blended in a 2. Step process, maintaining stated equalities for batch increases. Step one. 0.4167=part Extra Virgin Olive Oil First Cold Pressed and 0.5833=part IPA, Isopropyl Alcohol 70%, shake well to emulsify. Step two. place 0.0625=2 ounces of concentrate, from step one, in a 32 ounce plastic bottle with mist sprayer, fill with 0.4375=14 ounces of tap water, shake well to mix.

The invention, a stable composition of matter, suitable for a multi-functional all purpose cross-cleaner, used externally on the human body, waxy plant natural and man-made finished products, such as marble, metal, leather, wood, plastic, painted walls and painted decks. It also keeps cold ash particles from becoming air borne during removal process, removes soot from fire box opening and skin.

The invention, a stable composition of matter, is mixed in a two step process, maintaining stated equalities for batch increases, Step #1. Using a 6 ounce plastic bottle #3 and cap, place a funnel in the neck of the 6 ounce #3 plastic bottle. Pour 2.5 ounces of the Extra Virgin Olive Oil—First Cold Pressed into the 6 ounce plastic bottle. Then Pour 3.5 ounces of IPA, Isopropyl Alcohol 70% over the olive oil. Remove the funnel and replace cap, shake well to emulsify.

Step #2. In a 32 ounce spray mist bottle, with a good quality mist sprayer, pour 2 ounces of concentrate, from step #1, into the 32 ounce spray mist bottle, pour 14 ounces of tap water over the concentrate, replace mist sprayer and shake before using. The solution will have a halo on top when at rest, to use shake solution well. Spray surface with the solution, incredible mist, then dry with a soft towel or paper towel. Use for daily cleaning to enjoy a quality standard of cleanliness.

The invention, a stable composition of matter that will clean large items such as, an automobile. To clean use a bucket with 1-2 gallons of water and pour 2-3 ounces of concentrate on top of water, mix as you wash. Use a soft towel to wash and a couple of towels to dry immediately, as you wash, no pre-rinsing is needed, water should not be change just because it appears dirty, the dirt is mostly on the top of water's surface. To wash just dip towel in water and wipe clean, dry immediately.

The invention, a stable composition of matter, that cleans waxy plant leaves by spraying the leaves. The leaves and skin of waxy plants will shine, do not wipe leaves or skin of plants, let them dry naturally.

The invention, a stable composition of matter, will cleans natural and man-made finished products. Just spray natural and man-made finished products and wipe with a soft towel or plain paper towel, which ever is appropriate. If surface is heavy soiled, several spraying may be necessary.

The invention, a stable composition of matter, is suitable to cleans or refresh the body's skin by spraying it with the composition of matter solution and either letting the skin dry natural or pat drying, with a towel. When using on facial area, spray solution on a wash cloth, don't put in eyes, external use only. Sprayed on dry skin skin lotion may be used after spraying, use after a bath or shower, just dry off with a towel and then spray on the skin to remove soap residue and enjoy a cleaner softer feeling. Before manicuring place a towel under the hands and feet spray solution on both sides of the hands and feet area generously and let the solution soak in for 60 seconds before pat drying to manicuring.

The invention, a stable composition of matter, will removes flakes from the scalp, 10-15 minutes before shampooing and conditioning spray the scalp with the composition of matter solution and then shampoo, condition and towel dry as normal. Then spray towel dried hair generously with the solution to remove tangles to texture and shine hair. After a couple of months damage hair will look stronger, healthier and shine.

The invention, a stable composition of matter, will controls cold ash particles from becoming air borne while they are being remove from wood burning stoves and fireplaces. Spray cold ash completely and remove from stove or fireplace. Once sprayed the ash will not become air borne during the removal process. Put ash in a covered container. The ash may be put around plants. To remove soot from fire box and fire box doors and glass, spray and wipe with a paper towel. For heavy build-ups use a S.O.S. pad as you spray with composition of matter solution, this method can be used on any non scratch surfaces, and wipe with a plain paper towel, repeat until clean. Once cleaned just spray with solution and wipe with a plain paper towel. To remove soot from skin, spray with solution and leave for 30-60 second, wipe with plain paper towel.

The invention claimed is:

1. A multi-functional cleaning concentrate for cleaning humans, plants, and man made and natural finished material, said concentrate consisting of extra virgin olive oil and isopropyl alcohol (70%), wherein the concentrate is prepared by mixing the extra virgin olive oil and the isopropyl alcohol, and this concentrate may optionally be added to water and shaken to form an emulsion, which may be a concentrated or diluted cleaning composition, according to the desired application.

2. A method of cleaning or refreshing a surface selected from the group consisting of the skin, cuticles, scalp, hair, waxy plant leaves, counter tops, finished wood products, metals, porcelain, marble, glass, and automobile surfaces, the method comprising the steps of adding a concentrate consisting of extra virgin olive oil and isopropyl alcohol (70%) to water, preferably in a spray bottle, shaking the resulting composition to form an emulsion, spraying the resulting composition on the surface, and optionally rinsing and wiping the surface with a soft towel or paper towel, wherein the method does not require a pre-wetting or rinsing step and so delivers high quality cleaning with minimal water usage.

3. A method of controlling ash particles from becoming airborne during the cleaning of a wood stove or fireplace, the method comprising the steps of adding a concentrate consisting of extra virgin olive oil and isopropyl alcohol (70%) to water, preferably in a spray bottle, shaking the resulting composition to form an emulsion, and spraying the resulting composition on the ash, wherein the ash does not become wet, and so is easily removed with minimal water usage.

* * * * *